US006242704B1

(12) United States Patent
Ambrose et al.

(10) Patent No.: US 6,242,704 B1
(45) Date of Patent: Jun. 5, 2001

(54) CEILING FAN AND LIGHT CONTROL "STIK"

(76) Inventors: Joan Marie Ambrose; John Ambrose, Jr., both of 15 Hunter Rd., No. Haledon, NJ (US) 07508

( * ) Notice: Subject to any disclaimer, the term of this patent is extended or adjusted under 35 U.S.C. 154(b) by 0 days.

(21) Appl. No.: 09/542,922

(22) Filed: Apr. 4, 2000

(51) Int. Cl.[7] ..... H01H 17/00; A47F 13/06
(52) U.S. Cl. ..... 200/331; 294/19.1
(58) Field of Search ..... 200/331, 329–330, 200/332–332.2; 294/19.1

(56) References Cited

U.S. PATENT DOCUMENTS 275,042 * 4/1883 Heysinger ..... 200/331 X
519,354 * 5/1894 Sheppard ..... 200/331
5,498,845 * 3/1996 Browning ..... 200/331
5,951,074 * 9/1999 Guzzi et al. ..... 294/19.1
5,993,159 * 11/1999 Mack ..... 200/331 X

* cited by examiner

*Primary Examiner*—J. R. Scott

(57) ABSTRACT

The Control "STIK" is to be used in connection with a ceiling fan for snaring the pull chain and to engage the slide switch to control the rotation of the motor. The "STIK" is comprised of a long pole with an integrated snare hook at one end approximately 45 degrees with reference to the pole. The snare hook is a V-shaped or cone-shaped component that is used to permit the pull chain to slip into the snare hook sufficiently to engage the operation of the chain. The rectangular notch, located just below the snare hook, is used to engage the slide switch actuator and lower or raise it to a desired position for controlling the rotational direction of the motor.

3 Claims, 1 Drawing Sheet

CEILING FAN AND LIGHT CONTROL "STIK"

BACKGROUND OF THE INVENTION

Normally a ceiling fan is placed in such a manner so that an average consumer/homeowner cannot reach the speed switch nor the reversing switch of the fan. In order to benefit the consumer/homeowner to operate their personal fans in a safe environment, we have designed a Ceiling Fan and Light Control-"STIK" which can reach up to the fan and pull down on the short chain to accommodate the desired fan speed and circulation..Furthermore, if there is a light on the fan, our invention will also be able to turn the light on and off at will by utilizing the Ceiling Fan and Light Control-"STIK". The Control "STIK" will also allow the consumer/homeowner to change the direction of the fan blades as needed by using the rectangular notch on the side of the "STIK" to slide the switch actuator into the desired operating position.

It can be challenging to try to pull the chain with ones hand but it is most certainly dangerous to try and reach up and pull the chain when the fan is in motion. Our device will allow for the optimum safety of a persons hand and fingers as a person adjusts the control of the individual fan.

By utilizing this Control "STIK", the consumer/homeowner is allowed to have the ability to set the controls of the ceiling fan with an easy, economical and simple to store utility item. This Control "STIK" can be stored in a nearby closet whether standing on its end or attached to a home utility spring loaded clasp used for brooms or mops.

SUMMARY OF THE INVENTION

The Fan and Light Control "STIK" invention is constructed of a long pole which encompasses a heavy gauge wire snare hook at the top end to engage the wire pull chain either for the fan or light control switch. Directly below this snare is an off-set rectangular notch which is located at a 90 degree angle from the snare hook. The rectangular notch is used to change the rotation of the fan by placing the rectangular notch over the actuator of the slide switch and moving the slide switch actuator up or down depending upon the desired direction of the fan blades.

This pole device devise is made to simplify the operation of a consumer/homeowner fan in a safe and secure manner. This pole allows for the safe operation of fans that are installed in homes with ceilings in excess of eight (8) feet without the use of a ladder. The handle of the invention allows the consumer/homeowner the comfort and ease of securing a strong grip while extending the pole in the air. Furthermore, this invention allows the consumer/homeowner the ability to control the rotation of the fan by the use of the slide switch even if extension chains are used to control the fan or light.

DETAILED DESCRIPTION OF THE INVENTION

For a fuller understanding of the nature of the invention, reference should be made to the following detailed description taken in connection with the accompanying sketches which illustrate the invention.

Figure 1:
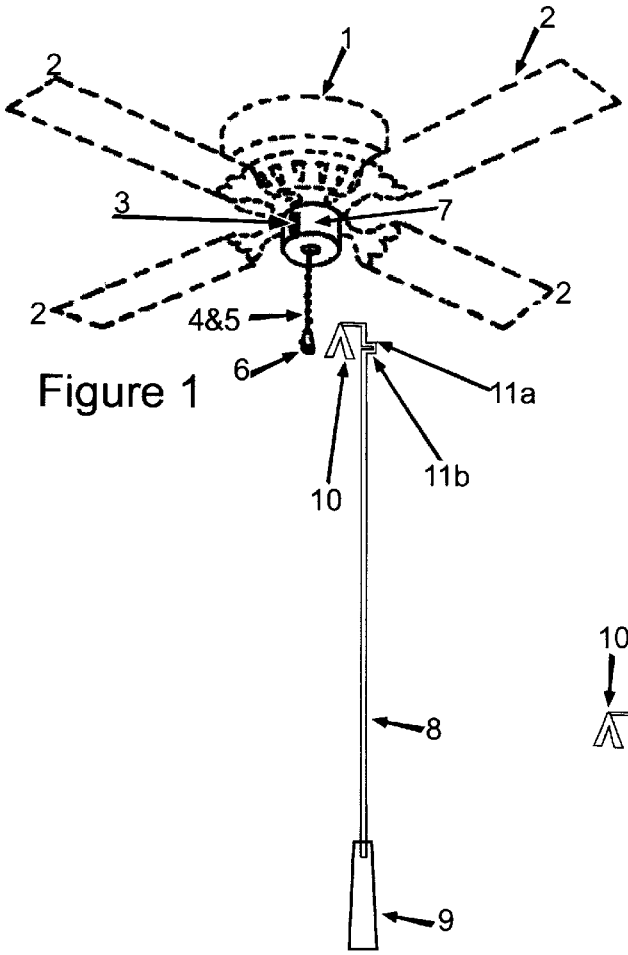
FIG. 1 is a sketch of a conventional ceiling fan denoting the various items that make up the complete unit.
Figure 4:
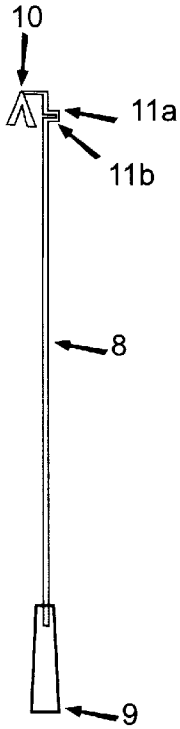
FIG. 4 is a frontal view of the Control "STIK" with the snare hook and the rectangular notch located at 90 degrees with respect to the snare hook.
Figure 3:
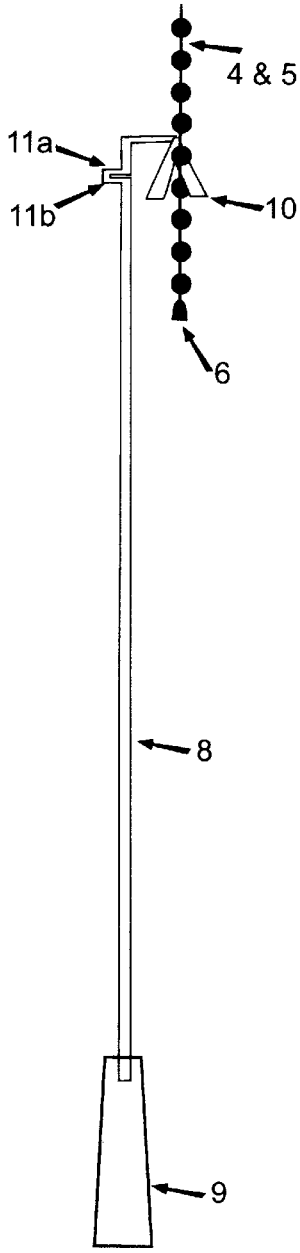
FIG. 3 is a detailed illustration of the Control "STIK", the pull chain engaged by the snare hook of the "STIK" and the features of the rectangular notch which moves the slide switch upward or down to control fan rotation.

The Control "STIK" 8 is illustrated in FIGS. 1,3 and 4. It is constructed of a rigid wire or rod at least ⅛ inch in diameter. The stick length is approximately 3 feet. A sturdy decorative handle 9 is mounted at the base of the Control "STIK".

The Control "STIK"8, as shown in FIG. 1, is positioned adjacent to the ceiling fan housing 1. The fan identified in FIG. 1 includes a number of blades 2, a pull chain 4 to control the light and a pull chain 5 to control the fan speed. Either or both of these pull chains may be used in the ceiling fan dependent upon the use. These chains extend from the switch housing 7 and are used to activate the light and the fan. At the end of the pull chain is a coned-shaped decorative metal attachment 6. The slide switch 3 has an actuator which is used to change the forward or reverse rotation modes of the motor. The slide switch actuator extends radially outward from the switch housing for movement in the vertical direction. This Control "SHTIK" 8 is best used for turning the light and/or speed of the fan on and off by engaging the snare hook with the pull chains 4 or 5. The Control "STIK" is simply raised to engage the pull chain by placing the V-shaped snare hook 10 in between the rings of the pull chain 4 or 5 and pulling down on it by grasping the decorative handle 9 and pulling down on the handle. This simple procedure will allow the snare hook 10 to change the fan speed or light intensity as desired.

Figure 2:
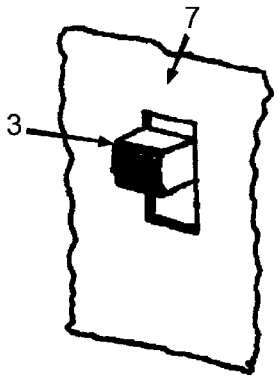
FIG. 2 is a sketch of the side mounted slide switch mounted on the fan housing to control the fan rotation.

FIG. 2 shows the switch housing 7 with the actuator of the slide switch 3 mounted on the side wall for vertical movement to adjust the fan rotation.

FIG. 3 shows the rectangular notch horizontal legs 11A and 11B located at a 90 degree angle with respect to the snare hook 10. The upper horizontal leg 11A of the rectangular notch engages the lower portion of the switch actuator to push the slide switch actuator vertically upward. The lower horizontal leg 11B is used to engage the slide switch actuator and lower it to a desired position.

FIG. 4 illustrates a frontal view of the snare hook 10 and the rectangular notch 11 and its horizontal legs 11A and 11B.

We claim:

1. A control "STIK" having a cone-shaped snare hook located at the top of the stik for operating one or more pull chains to control a light or fan speed, said snare hook being located between the balls of one of the pull chains for subsequently pulling down the pull chain to select the desired operation.

2. A fan and light control "STIK" as set forth in claim 1 further including a rectangular notch located at a 90 degree angle from the snare hook to allow the operator to independently control a slide switch in one of a plurality of positions to change the rotation of the fan.

3. The fan and light control "STIK" including a rectangular notch located just below the cone-shaped snare hook located at a 90 degree angle for the operation of the slide switch actuator is utilized by placing the of the horizontal legs of the notch either above or under the actuator of the slide switch to move the slide switch actuator up or down to achieve a desired position.

* * * * *